US006247693B1

(12) United States Patent
Kawano

(10) Patent No.: US 6,247,693 B1
(45) Date of Patent: Jun. 19, 2001

(54) BILL FEED-OUT DEVICE

(75) Inventor: Ichiro Kawano, Tokyo (JP)

(73) Assignee: Laurel Bank Machines Co., Ltd., Tokyo (JP)

( * ) Notice: Subject to any disclaimer, the term of this patent is extended or adjusted under 35 U.S.C. 154(b) by 0 days.

(21) Appl. No.: 09/234,398

(22) Filed: Jan. 20, 1999

(30) Foreign Application Priority Data

Jan. 29, 1998 (JP) ..... 10-017536
Dec. 28, 1998 (JP) ..... 10-372124

(51) Int. Cl.[7] ..... B65H 5/22

(52) U.S. Cl. ..... 271/3.05; 271/4.08; 271/10.09; 271/121; 271/125

(58) Field of Search ..... 271/3.05, 10.09, 271/10.11, 121, 124, 125, 4.08, 4.1

(56) References Cited

U.S. PATENT DOCUMENTS

| | | | |
|---|---|---|---|
| 4,275,874 | 6/1981 | DiBlasio | 271/4.1 |
| 4,834,362 | 5/1989 | Uehara | 271/3.05 |
| 5,211,388 | 5/1993 | Walluk | 271/125 X |

FOREIGN PATENT DOCUMENTS

| | | | |
|---|---|---|---|
| 2105690 | 3/1983 | (GB) | 271/4.1 |
| 61-45856 | 3/1986 | (JP) | 271/3.05 |
| 2-175528 | 7/1990 | (JP) . | |
| 3-79531 | 4/1991 | (JP) . | |
| 7-137870 | 5/1995 | (JP) . | |

*Primary Examiner*—David H. Bollinger
(74) *Attorney, Agent, or Firm*—Frishauf, Holtz, Goodman, Langer & Chick, P.C.

(57) ABSTRACT

A bill feed-out device adapted for dispensing bills from a bill storage box includes a bill stacking plate disposed in the bill storage box to support stacked bills on its upper surface, kick rollers provided below the bill stacking plate to be contactable with a bottommost bill of the bills stacked on the bill stacking plate for kicking the bottommost bill laterally, a feed-out roller, having multiple large-diameter portions and multiple small-diameter portions, for feeding further downstream bills kicked out by the kick rollers, separation rollers, each of which have multiple large-diameter portions and multiple small-diameter portions and whose multiple large-diameter portions can mesh into the multiple small-diameter portions of the feed-out roller for separating one by one bills present between itself and the feed-out roller, a stacked bill number detector for detecting the number of bills stacked on the bill stacking plate, a bite amount regulator responsive to the number of stacked bills detected by the stacked bill number detector for regulating depth of meshing of the multiple large-diameter portions of the separation rollers into the multiple small-diameter portions of the feed-out roller. According to the thus constituted bill feed-out device, it is possible to reliably dispense bills one at a time even when the number of bills stacked therein becomes large.

24 Claims, 6 Drawing Sheets

FIG. 6

| NUMBER OF STACKED BILLS | BITE AMOUNT | |
|---|---|---|
| | PRESSER OPERATIVE | PRESSER INOPERATIVE |
| 10 k ~9 k | | A |
| 9 k ~8 k | | B |
| 7 k ~6 k | | C |
| 6 k ~5 k | | D |
| 5 k ~4 k | | E |
| 4 k ~3 k | | F |
| 3 k ~2 k | H | G |
| 2 k ~ k | I | |
| k ~1 | J | |

BILL FEED-OUT DEVICE

FIELD OF THE INVENTION

The present invention relates to a bill feed-out device and particularly to a bill feed-out device which can reliably dispense bills one bill at a time even when the number of bills stacked therein becomes large.

DESCRIPTION OF THE PRIOR ART

Japanese Patent Application Laid Open No. 2-175528 teaches a bill feed-out device configured to dispense vertically stacked bills one bill at a time from the bottommost. This bill feed-out device comprises kick rollers that contact the undersurface of the bottommost bill of the stacked bills and kicks it laterally, a feed-out roller that contacts the undersurface of the bill kicked out by the kick rollers and further feeds it laterally, and separation rollers facing the feed-out roller from above and produces friction between the bill and the feed-out roller to ensure dispensing of the bills one by one.

With bill handling machines being called on to process ever larger numbers of bills in recent years, the number of bills that must be stacked in such machines has risen in proportion.

When the number of bills stacked in a bill feed-out device that dispenses bills from the bottommost one of the stack in the foregoing manner is increased, however, the increased weight of the stacked bills produces large frictional forces between the kick rollers and the bottommost bill as well as among the bills near the bottom of the stack. The likelihood of two or more bills being simultaneously fed between the feed-out roller and the separation rollers and of the feed-out roller and the separation rollers being incapable of separating them therefore rises. The result is degraded ability of the feed-out device to ensure that the bills are dispensed one at a time.

SUMMARY OF THE INVENTION

It is therefore an object of the present invention to provide a bill feed-out device that can reliably dispense bills one at a time even when the number of bills stacked therein becomes large.

The above and other objects of the present invention can be achieved by a bill feed-out device adapted for dispensing bills from a bill storage box, said bill feed-out device comprising a bill stacking plate disposed in the bill storage box to support stacked bills on its upper surface, at least one kick roller means provided below the bill stacking plate to be contactable with a bottommost bill of the bills stacked on the bill stacking plate for kicking the bottommost bill laterally, a feed-out roller means, located downstream relative to a bill kick-out direction of the kick roller means and having multiple large-diameter portions and multiple small-diameter portions, for feeding further downstream bills kicked out by the kick roller means, at least one separation roller means which has multiple large-diameter portions and multiple small-diameter portions and whose multiple large-diameter portions can mesh into the multiple small-diameter portions of the feed-out roller means for separating one by one bills present between itself and the feed-out roller means, a stacked bill number detecting means for detecting the number of bills stacked on the bill stacking plate, a bite amount regulating means responsive to the number of stacked bills detected by the stacked bill number detecting means for regulating depth of meshing of the multiple large-diameter portions of the separation roller means into the multiple small-diameter portions of the feed-out roller means.

In a preferred aspect of the present invention, the bite amount regulating means regulates the meshing depth of the at least one separation roller means into the feed-out roller means to increase the meshing depth of the multiple large-diameter portions of the separation roller means into the multiple small-diameter portions of the feed-out roller means in proportion as number of stacked bills detected by the stacked bill number detecting means increases.

In a preferred aspect of the present invention, the bite amount regulating means includes step motor means and a rotation angle of a drive shaft of the step motor means can be detected by rotary encoder means.

In a further preferred aspect of the present invention, the bill feed-out device further comprises step motor means for raising and lowering the bill stacking plate and the stacked bill number detecting means detects the number of bill stacked on the bill stacking plate based on a number of pulses applied to the step motor.

In a further preferred aspect of the present invention, the bill feed-out device further comprises a dispensed bill sensor installed downstream of the feed-out roller means for counting the number of bills fed out by the feed-out roller means.

In a further preferred aspect of the present invention, the bill feed-out device further comprises, in addition to the dispensed bill sensor, an incoming bill sensor for counting the number of bills taken into the bill storage box.

In a further preferred aspect of the present invention, the bill feed-out device further comprises multiple sensors spaced vertically in the bill storage box.

In a further preferred aspect of the present invention, the bill feed-out device further comprises a bill number input means for inputting the number of bills from outside.

In a further preferred aspect of the present invention, the bill feed-out device further comprises a presser means for pressing down on the bills stacked on the bill stacking plate from above when less than a prescribed number of bills are stacked on the bill stacking plate and the bite amount regulating means is adapted to increase the meshing depth of the multiple large-diameter portions of the separation roller means into the multiple small-diameter portions of the feed-out roller means when the presser means presses down on the bills stacked on the bill stacking plate from above.

In a further preferred aspect of the present invention, the bill feed-out device further comprises a stack height sensor for detecting based on the stack height of the bills stacked on the bill stacking plate whether or not the number of bills stacked on the bill stacking plate has reached the prescribed number.

In a further preferred aspect of the present invention, the bill feed-out device further comprises at least one arm means whose one end portion is swingably attached to a support shaft and whose other end supports at least one separation roller means, and at least one swinging means for swinging the arm means, the bite amount regulating means being adapted to regulate the meshing depth of the multiple large-diameter portions of the separation roller means into the multiple small-diameter portions of the feed-out roller means by swinging the swinging means about the support shaft.

The above and other objects and features of the present invention will become apparent from the following description made with reference to the accompanying drawings.

BRIEF DESCRIPTION OF THE DRAWINGS

FIG. 6 is a table showing an example of a relationship defined between the number of bills stacked on an elevator plate and the bite amount (meshing depth) of separation rollers into a feed-out roller.

DESCRIPTION OF THE PREFERRED EMBODIMENT

Figure 1:
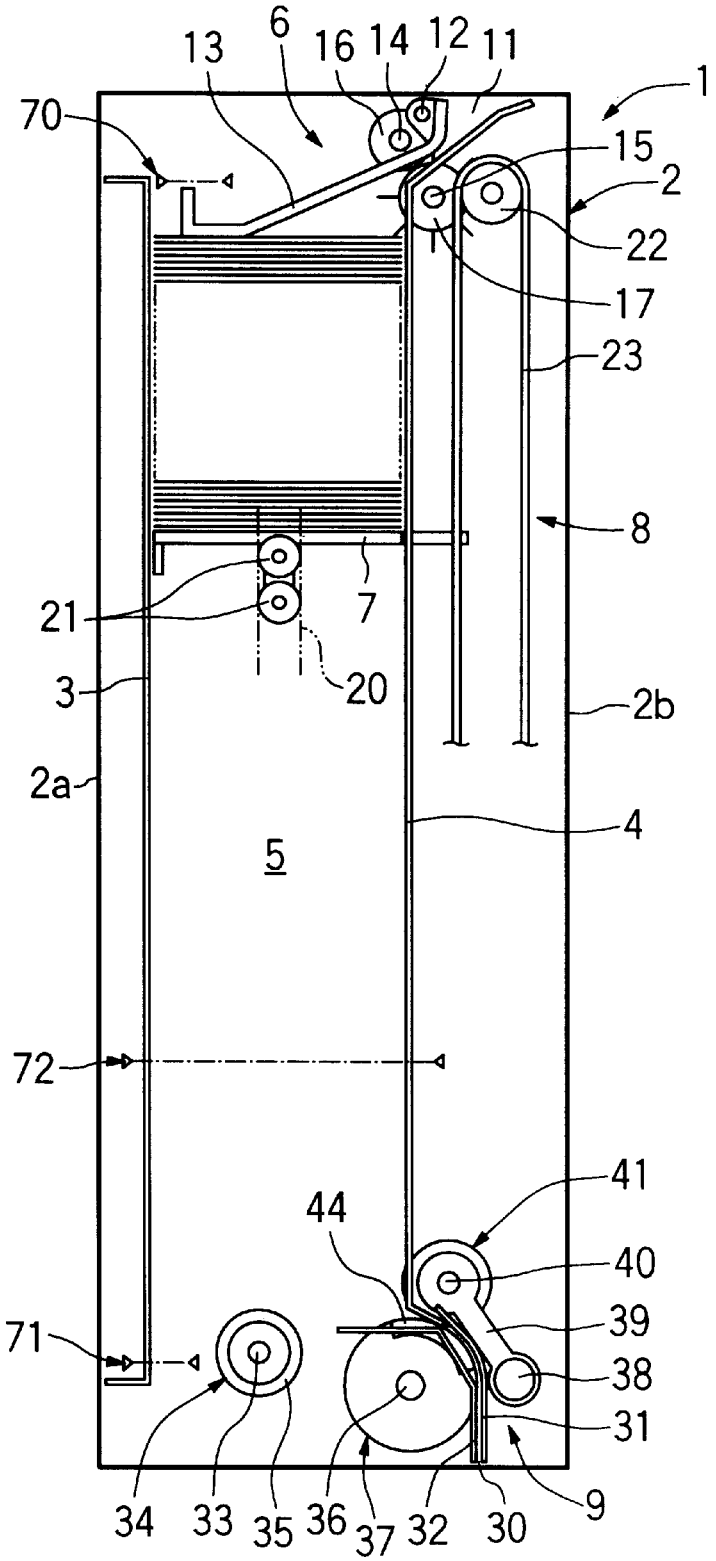
FIG. 1 is schematic sectional view of a bill stacker including a bill feed-out device that is an embodiment of the present invention.
Figure 2:
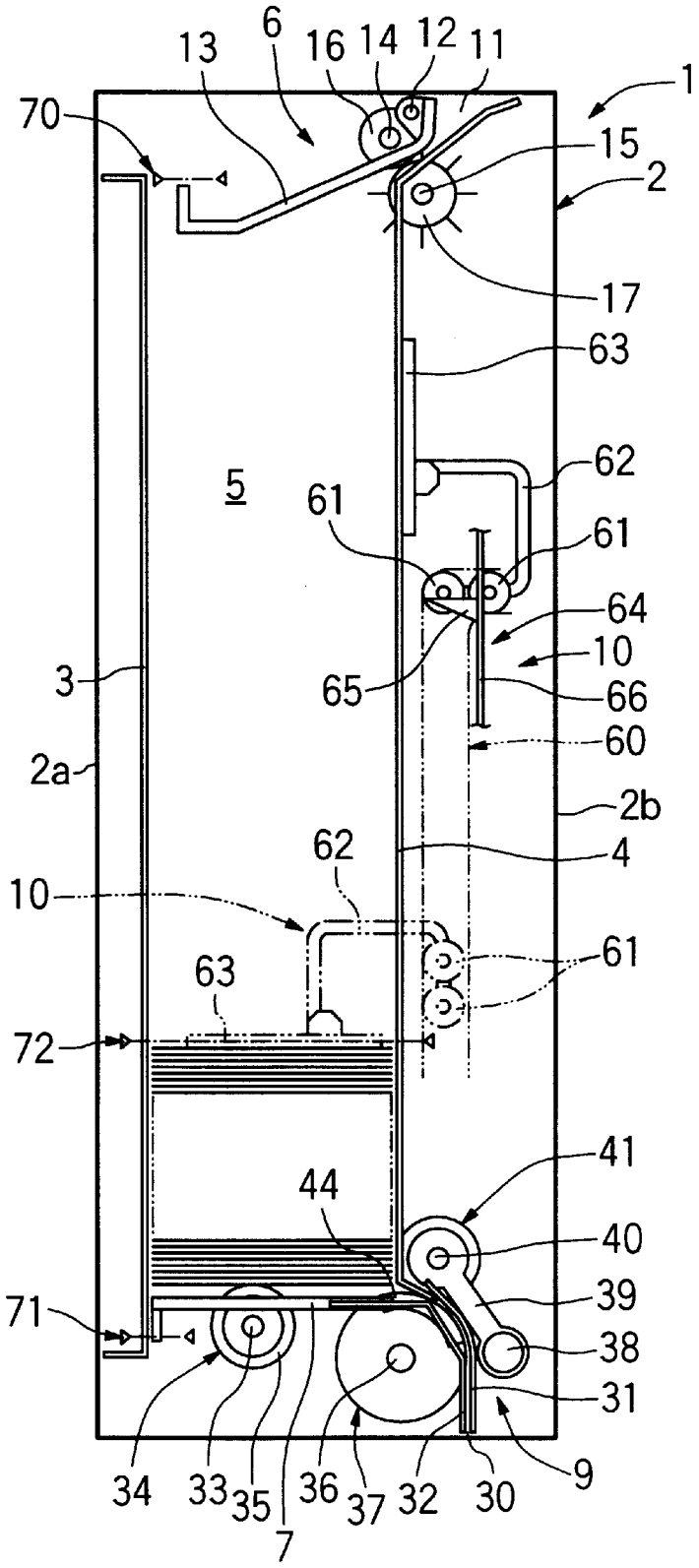
FIG. 2 is another schematic sectional view of the bill stacker including a bill feed-out device that is an embodiment of the present invention.

As shown in FIGS. 1 and 2, a bill stacker 1 for installation in a bill handling machine such as a bill deposit and withdrawal machine can internally store deposited bills in a substantially vertical stack and can dispense the bills when required. The bill stacker 1 can be installed in and removed from the bill handling machine as necessary.

The bill stacker 1 has a box-shaped housing 2 installed upright in the bill handling machine. Parallel guide plates 3 and 4 are installed vertically inside the housing 2 near its opposite sides 2*a* and 2*b*, respectively. A bill stacking space 5 for stacking bills is defined between the guide plates 3 and 4. Top and bottom portions of the guide plate 4 are bent toward the side 2*b* of the housing 2.

The bill stacker 1 is also provided at an upper portion of the housing 2 with a bill take-in section 6 for taking in bills, and further with an elevator plate 7 adapted to receive stacked bills on its upper surface, an elevator mechanism 8 for moving the elevator plate 7 vertically, a feed-out device 9 provided at a lower portion of the housing 2 for dispensing bills out of the housing 2, and a presser 10 for pressing down on the bills stacked on the elevator plate 7 when bills are dispensed.

A bill inlet 11 is provided in the housing 2 for guiding bills into the bill stacking space 5.

The bill take-in section 6 comprises a horizontal support shaft 12 installed above the guide plate 4 to run parallel to the sides 2*a* and 2*b* of the housing 2 and a bill guide plate 13 swingably mounted on the support shaft 12. The bill guide plate 13 serves to guide bills taken into the bill stacker 1 along its undersurface. Its distal end is bent upward.

The bill take-in section 6 is further equipped with horizontal support shafts 14 and 15 that run parallel to the sides 2*a* and 2*b* of the housing 2 at a location near the bill inlet 11. The support shaft 14 supports a take-in roller 16 and the support shaft 15 supports a vane wheel 17. Bills inserted via the bill inlet 11 are caught between the take-in roller 16 and the vane wheel 17 and conveyed into the bill stacking space 5 one at a time. The take-in roller 16 is rotated by a motor (not shown). The vane wheel 17, which rotates as a slave following the rotation of the take-in roller 16, scrapes down the rear end of each bill taken in.

The elevator mechanism 8 is installed inside the housing 2. It includes a vertically extending guide rail 20 and a pair of rollers 21, 21 guided by the guide rail 20. The shafts of the rollers 21, 21 are fastened to a common member (not shown) and support the elevator plate 7.

The elevator mechanism 8 is further equipped with a pair of pulleys 22, 22 having vertically-spaced horizontal shafts (only the upper pulley is shown in FIG. 1), a drive belt 23 wrapped around the pulleys 22, 22, and a step motor (not shown in FIG. 1) for rotating one pulley 22. The elevator plate 7 is fastened to the side of the drive belt 23 nearer the guide plate 4.

Figure 3:
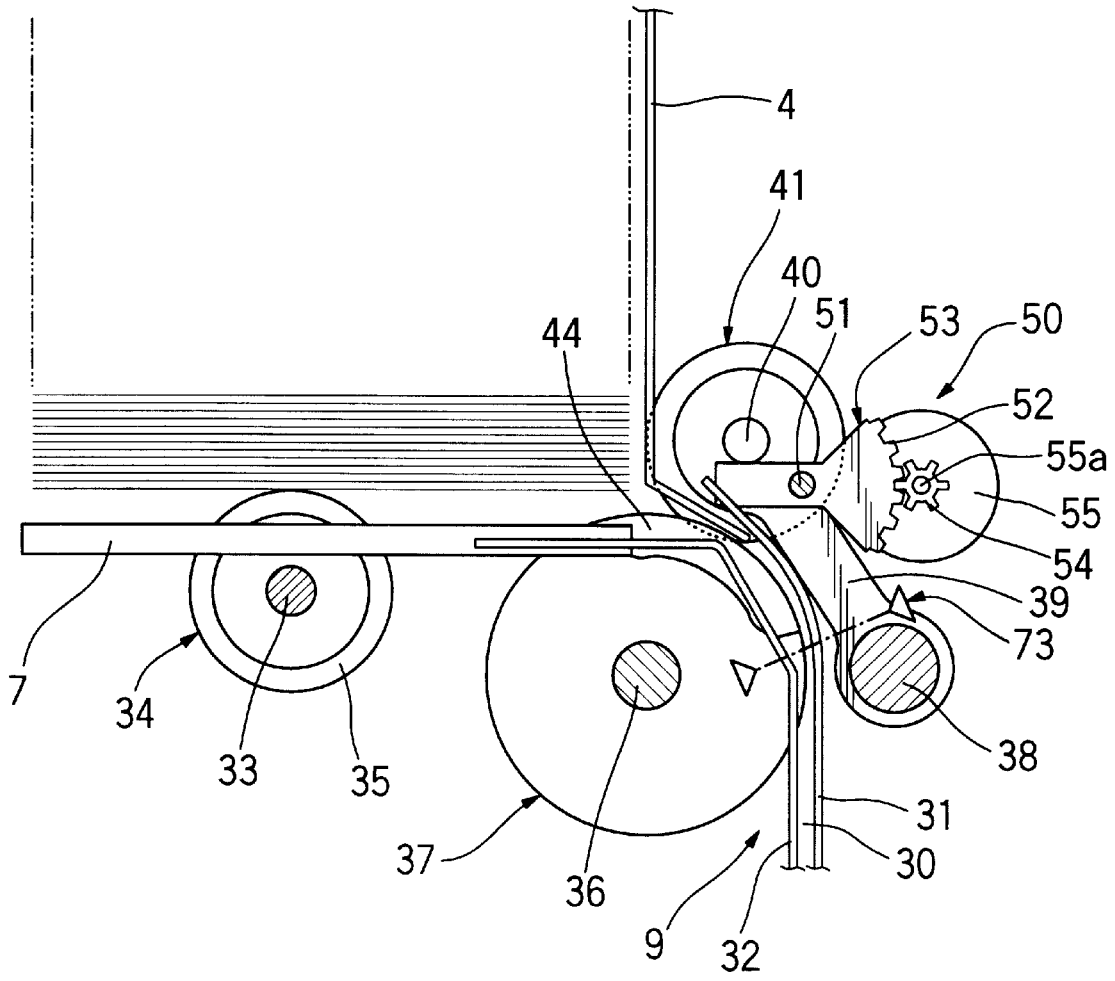
FIG. 3 is a schematic enlarged side view of the bill feed-out device.

FIG. 3 is a schematic enlarged side view of the feed-out device 9.

As shown in FIG. 3, the feed-out device 9 is provided with a dispensing passage 30 for dispensing bills stacked in the bill stacking space 5 to a point downstream of the bill handling machine. The top side of the dispensing passage 30 is defined by the lower end portion of the guide plate 4 and a guide plate 31 continuing therefrom. Its bottom side is defined by a guide plate 32.

The feed-out device 9 also includes a horizontal support shaft 33 attached to the housing 2 between the guide plates 3, 4 and kick rollers 34, 34 (only one shown in FIG. 3) rotatably supported on the support shaft 33 under the housing 2. As can be seen in FIGS. 2 and 3, the kick rollers 34, 34 are located so that when the elevator plate 7 is at it lowest position they can make contact with the bottommost of the bills stacked on the upper surface of the elevator plate 7 by projecting upward of the elevator plate 7 through openings formed therein (not shown). The kick rollers 34, 34 are clad with high-friction material 35 and are driven by a motor (not shown) to rotate clockwise and kick the bottommost bill to the right, as viewed in FIGS. 1 to 3.

The feed-out device 9 further comprises a support shaft 36 mounted on the housing 2 under the guide plate 4 to lie parallel to the support shaft 33, a feed-out roller 37 supported on the support shaft 36 so that a portion thereof projects above the lower end of the guide plate 4, a support shaft 38 mounted on the housing 2 at a location on the opposite side of the guide plate 31 from the support shaft 33 to lie parallel to the support shafts 33 and 36, a pair of arms 39, 39 (only one shown in FIGS. 1 to 3) swingably supported on the support shaft 38, a pair of support shafts 40, 40 (only one shown in FIGS. 1 to 3) mounted on the opposite ends of the arms 39, 39 from the support shaft 38 to lie parallel to the support shaft 38, and a pair of separation rollers 41, 41 (only one shown in FIGS. 1 to 3) supported one on each of the support shafts 40, 40.

Driven by the motor (not shown) that drives the kick rollers 34, 34, the feed-out roller 37 is rotated clockwise as viewed in FIGS. 1 to 3 to pass each bill kicked out by the kick rollers 34, 34 between itself and the separation rollers 41, 41, thereby dispensing it through the dispensing passage 30.

Figure 4:
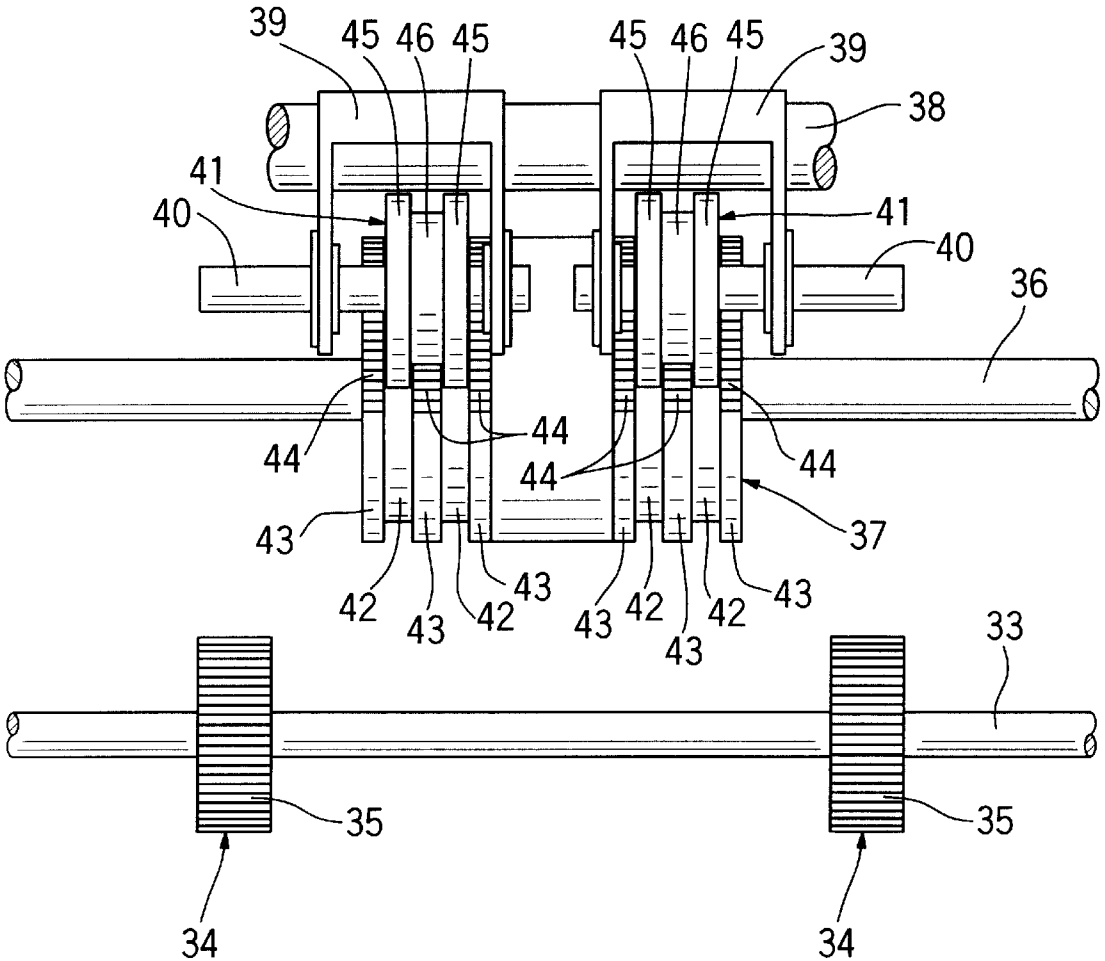
FIG. 4 is a schematic enlarged side view of an essential portion of the bill feed-out device.

FIG. 4 is a schematic enlarged side view of an essential portion of the bill feed-out device 9.

As shown in FIG. 4, the feed-out roller 37 comprises four small-diameter portions 42 and six large-diameter portions 43. Each large-diameter portion 43 is partially clad with a high-friction material 44.

Each separation roller 41 is clad with a high-friction material and can rotate only clockwise as viewed in FIG. 3. Each separation roller 41 has a small-diameter portion 46 between two large-diameter portions 45. The width of the large-diameter portions 45, 45 of the separation rollers 41, 41 is smaller than the width of the small-diameter portions 42, 42 . . . of the feed-out roller 37. The large-diameter portions 45, 45 of the separation rollers 41, 41 are aligned to oppose the small-diameter portions 42, 42 . of the feed-out roller 37 and each can bite into feed-out roller 37 by entering the space defined by a pair of adjacent large-diameter portions 43, 43 and an intervening small-diameter portion 42.

As shown in FIG. 3, the feed-out device 9 is equipped with a pair of bite amount regulators 50, 50 (only one shown in FIG. 3) for regulating the distance between the support shafts 40, 40 of the separation rollers 41, 41 and the support shaft 36 of the feed-out roller 37 so as to regulate the meshing depth of the separation rollers 41, 41 into the feed-out roller 37.

Each bite amount regulator 50 comprises a spring (not shown) for biasing the separation roller 41 counterclockwise as viewed in FIG. 3, a support shaft 51 fixed on the housing 2 to lie parallel to the support shaft 38, an arm 53, supported on the support shaft 51, whose one end contacts the underside the associated support shaft 40 and whose other end is formed into a sector gear 52, a reversible step motor 55 having a drive shaft 55*a*, a gear 54 attached to the drive shaft 55*a* of the step motor 55 and engaged with the sector gear 52 of the arm 53, and a rotary encoder (not shown) for detecting the rotational angle of the drive shaft 55*a* of the step motor 55.

As shown in FIG. 2, the presser 10 comprises a guide rail 60 formed on the housing 2 to extend generally vertically between the guide plate 4 and the side 2*b* of the housing 2 but to bend toward the side 2*b* of the housing 2 only at its upper end portion, a pair of rollers 61, 61 that move along the guide rail 60, an L-shaped arm 62 supported by the pair of rollers 61, 61, a presser plate 63 attached to the distal end of the L-shaped arm 62, and an elevator device 64 for raising and lowering the rollers 61, 61 along the guide rail 60. The shafts of the rollers 61, 61 are fixed to a common member (not shown).

The elevator device 64 comprises a pair of pulleys (not shown) whose shafts lie horizontal and parallel to the side 2*b* of the housing 2, a drive belt 66 wound around the pair of pulleys, an elevator member 65 attached to the drive belt 66 and adapted to contact the underside of the shaft of the lower one of the rollers 61, 61, and a motor (not shown) for driving the drive belt 66 via one of the pulleys. During dispensation of bills stacked on the elevator plate 7, the drive belt 66 can be driven to separate the elevator member 65 from the lower roller 61 so that the presser plate 63 descends onto the bills stacked on the elevator plate 7 to press down on the stacked bills by its own weight.

A sensor 70 for detecting the bill guide plate 13 and a sensor 71 for detecting whether or not the elevator plate 7 is located at its lowest position are provided in the housing 2.

Also provided in the housing 2 is a sensor 72 for detecting whether or not a prescribed number of bills are stacked on the elevator plate 7 when the elevator plate 7 is located at its lowest position. The prescribed number of bills is defined as the minimum number of bills whose weight produces enough friction between the bottommost bill and the kick rollers 34, 34 to ensure kick-out of the bottommost of the stacked bills by the kick rollers 34, 34 even if the bills stacked on the elevator plate 7 are not pressed down by the presser 10.

Further, a sensor (not shown) is provided for detecting whether or not the elevator member 65 is at its lowest position (the "dispensation position") and a sensor (not shown) is provided for detecting whether or not the presser plate 63 has been raised to the point where it is withdrawn from the bill stacking space 5 (the "retracted position") as shown in FIG. 2.

Moreover, as shown in FIG. 3, a sensor 73 for detecting bills dispensed from the bill stacker 1 is provided downstream of the feed-out roller 37 and the separation rollers 41, 41 relative to the direction of bill dispensation.

Figure 5:
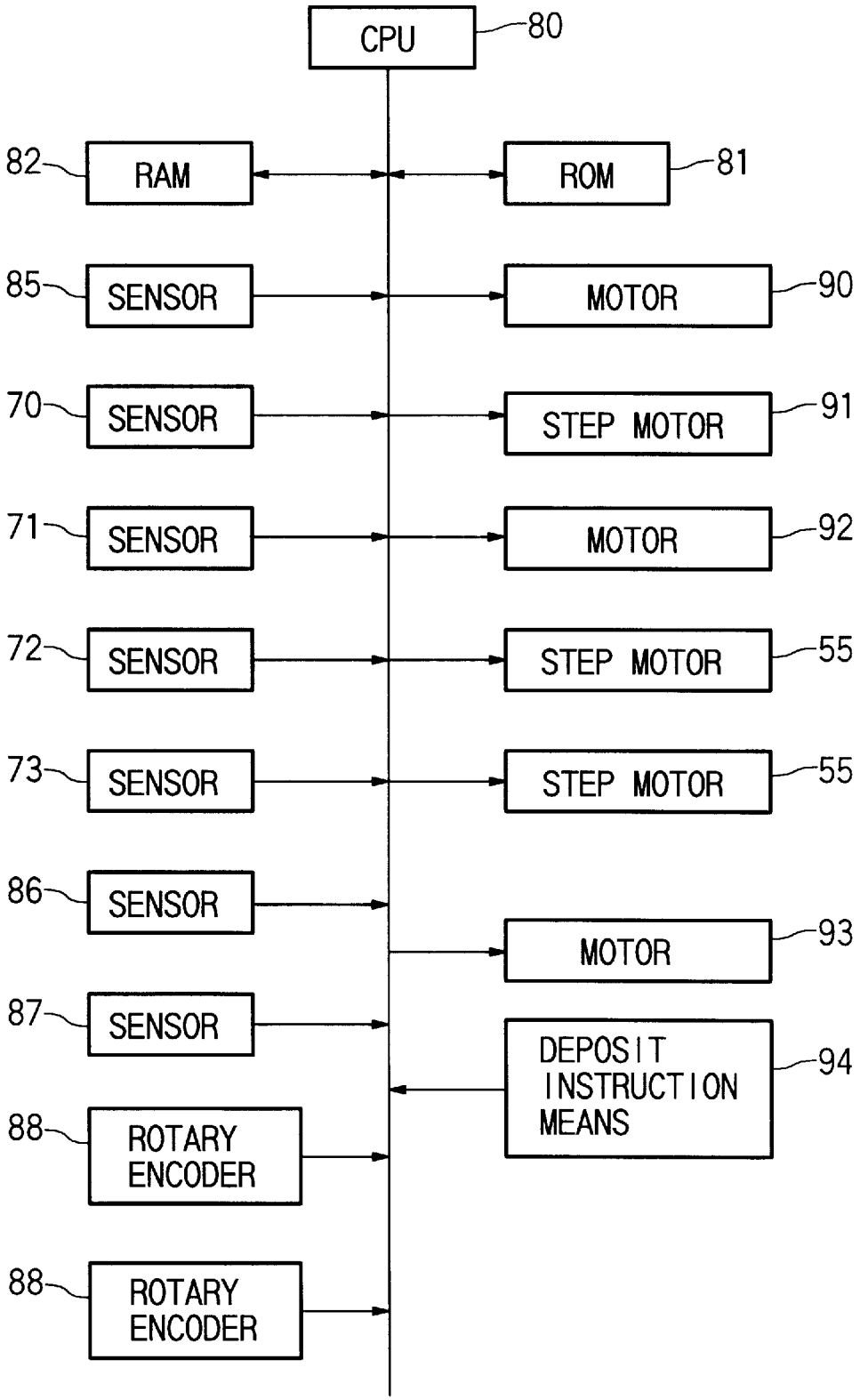
FIG. 5 is a block diagram of the control system, detection system, drive system and input system of a bill handling machine including a bill feed-out device that is an embodiment of the invention.

FIG. 5 is a block diagram of the control system, detection system, drive system and input system of a bill handling machine including a bill feed-out device that is an embodiment of the invention.

As shown in FIG. 5, the control system of the bill handling machine comprises a CPU (central processing unit) 80, a ROM (read-only memory) 81 storing a program, basic data and the like for controlling the operation of the bill handling machine, and a RAM (random access memory) 82 for storing the number of bills fed into the bill stacker 1 and other data.

As also shown in FIG. 5, the detection system of the bill handling machine includes a sensor 85, installed inside a bill discrimination passage (not shown), for discriminating the genuineness and denomination of the bills and also counting the number of the bills, the sensor 70 for detecting the bill guide plate 13, the sensor 71 for detecting whether or not the elevator plate 7 is located at its lowest position, the sensor 72 for detecting whether or not the bills stacked on the elevator plate 7 have reached the prescribed number, the sensor 73 for detecting bills dispensed from the bill stacker 1, a sensor 86 for detecting whether or not the elevator member 65 is at the dispensation position, a sensor 87 for detecting whether or not the elevator member 65 is at the retracted position, and a pair of rotary encoders 88, 88.

The drive system of the bill handling machine includes a motor 90 for driving the take-in roller 16, a step motor 91 for rotating one pulley 22 to raise and lower the elevator plate 7, a motor 92 for rotating the kick rollers 34, 34 and the feed-out roller 37, the reversible step motors 55, 55 on whose drive shafts the gears 54, 54 are fixed to engage with the sector gears 52, 52 of the arms 53, 53, and a motor 93 for driving the drive belt 66 to raise and lower the elevator member 65 and the presser plate 63.

The input system of the bill handling machine comprises a deposit instruction unit 94 used to enter the value or the number of the bills deposited in the bill handling machine.

The bill feed-out device constituted as an embodiment of the present invention in the foregoing manner is controlled as follows prior to taking bills into the bill stacker 1.

The CPU 80 first determines based on the detection signal from the sensor 71 whether or not the elevator plate 7 is located at its lowest position.

If the elevator plate 7 is found not to be at the lowest position, the step motor 91 is operated to lower the elevator plate 7 until it is detected by the sensor 71.

The CPU 80 next operates the step motor 91 to raise the elevator plate 7 until the sensor 70 detects the bill guide plate 13, whereupon it stores the number of pulses applied to the step motor 91 for this operation in the RAM 82. The number of pulses stored in the RAM 82 thus represents the distance of the elevator plate 7 from the lowest position.

When the CPU 80 receives the detection signal indicating detection of the bill guide plate 13 from the sensor 70, it operates the step motor 91 to lower the elevator plate 7 until input of the bill guide plate 13 detection signal from the sensor 70 terminates and thereafter sends it a predetermined number of pulses to lower the elevator plate 7 a predetermined distance D equivalent to the thickness of i number of bills, i being a positive integer. The position of the elevator plate 7 upon being lowered the prescribed distance D by applying the prescribed number of pulses to the step motor 91 starting from termination of input of the bill guide plate 13 detection signal from the sensor 70 is called the "take-in position."

When the elevator plate 7 is positioned at the take-in position and one or more bills are stacked on the elevator plate 7, spaces of given magnitude are always established between the upper surface of the uppermost bill stacked on the elevator plate 7 and each of the bill inlet 11, the support shaft 14 and the support shaft 15, irrespective of the number of stacked bills. When no bills are stacked on the elevator plate 7, the spaces of given magnitude are established between the upper surface of the elevator plate 7 and each of the bill inlet 11, the support shaft 14 and the support shaft 15.

The CPU 80 stores the number of pulses applied to the step motor 91 in the RAM 82. The position of the elevator plate 7 can therefore be known from the data stored in the RAM 82.

When the bill handling machine receives a deposit signal and deposited bills are to be taken into the bill stacker 1, the CPU 80 moves the elevator plate 7 to the take-in position and then operates the motor 90 to rotate the take-in roller 16.

The bills are fed into a bill discrimination passage (not shown) where they are discriminated for genuineness and denomination and counted by the sensor 85. They are then fed into the bill inlet 11. The CPU 80 stores the bill count from the sensor 85 in the RAM 82.

The bills fed into the bill inlet 11 are taken into the bill stacker 1 by the take-in roller 16, which is rotated by the motor 90, and the vane wheel 17, which rotates as a slave following the rotation of the take-in roller 16, and are stacked on the elevator plate 7 or on the uppermost bill stacked on the elevator plate 7.

When the CPU 80 receives a detection signal from the sensor 70 indicating that the bill guide plate 13 has been detected owing to stacking of a prescribed number of bills on the elevator plate 7 or on the uppermost bill stacked on the elevator plate 7, it operates the step motor 91 to lower the elevator plate 7 until input of the bill guide plate 13 detection signal from the sensor 70 terminates and thereafter sends it a predetermined number of pulses to lower the elevator plate 7 a predetermined distance D so as to bring it to the take-in position.

Bills are successively stacked on the elevator plate 7 by repeating the foregoing operations.

The ROM 81 stores two tables. The first shows the relationship between the number of pulses applied to the step motor 91 and the position of the elevator plate 7. The second shows the relationship between the position of the elevator plate 7 and the number of bills stacked on the elevator plate 7. The CPU 80 uses the data stored in the RAM 82 regarding the number of pulses applied to the step motor 91 and the tables stored in the ROM 81 to work out the number of bills stacked on the elevator plate 7 and stores the result in the RAM 82.

When the bill handling machine receives a bill withdrawal signal and bills taken into the bill stacker 1 and stacked on the elevator plate 7 are to be dispensed from the bill stacker 1, the CPU 80 first checks the detection signal from the sensor 71. If the detection signal is being received, the CPU 80 decides that the elevator plate 7 is located at its lowest position. If it is not being received, i.e., if the elevator plate 7 is not at the lowest position, the CPU 80 operates the step motor 91 to lower the elevator plate 7 until the sensor 71 detects the elevator plate 7.

When the CPU 80 receives the detection signal indicating that the sensor 71 has detected the elevator plate 7, it checks whether the bill stack is detected by the sensor 72.

If the bill stack is detected by the sensor 72, this means that a number of bills is stacked on the elevator plate 7 whose weight produces enough friction between the bottommost bill and the kick rollers 34, 34 to ensure kick-out of the bottommost of the stacked bills by the kick rollers 34, 34 even if the bills stacked on the elevator plate 7 are not pressed down by the presser 10. The CPU 80 therefore does not output a drive signal to the motor 93 for operating the elevator member 65 and the presser plate 63, i.e., the presser plate 63 is kept in the retracted position outside of the bill stacking space 5.

To the contrary, if the bill stack is not detected by the sensor 72, this means that the function between the bottommost bill and the kick rollers 34, 34 will be insufficient to ensure kick-out of the bottommost of the stacked bills by the kick rollers 34, 34 unless the bills stacked on the elevator plate 7 are pressed down by the presser 10. The CPU 80 therefore outputs a drive signal to the motor 93 so as to lower the elevator member 65 and the presser plate 63 and bring the elevator member 65 to the dispensation position. Since the presser plate 63 therefore descends onto the upper surface of the uppermost bill stacked on the elevator plate 7, its weight presses down on the bills stacked on the elevator plate 7.

In this embodiment, the feed-out device 9 is constituted so that the bite amount of the separation rollers 41, 41 into the feed-out roller 37 is regulated in accordance with the number of bills stacked on the elevator plate 7. Therefore, as the number of bills stacked on the elevator plate 7 increases, so does the frictional force among the bills near the bottom of the stack. This increases the likelihood of two or more bills being simultaneously kicked out and of the feed-out roller 37 and the separation rollers 41, 41 being incapable of separating them one by one. This embodiment of the present invention is therefore configured to enable regulation of the bite amount (meshing depth) of the separation rollers 41, 41 into the feed-out roller 37 as a function of the number of bills stacked on the elevator plate 7. Specifically, the bite amount of the separation rollers 41, 41 into the feed-out roller 37 is increased as the number of bills stacked on the elevator plate 7 increases. A table defining the relationship between the number of bills stacked on the elevator plate 7 and the bite amount of the separation rollers 41, 41 into the feed-out roller 37 is stored in the ROM 81 for this purpose.

FIG. 6 is a table showing an example of the relationship defined between the number of bills stacked on the elevator plate 7 and the bite amount of the separation rollers 41, 41 into the feed-out roller 37.

As shown in FIG. 6, in this embodiment the bite amount of the separation rollers 41, 41 into the feed-out roller 37 is increased each time the number of bills stacked on the elevator plate 7 increases by k. The value of k is set to be larger than (k>i). This is because when the elevator plate 7 is lowered by a distance equal to the thickness of i number of bills and the number of bills stacked on the elevator plate 7 is calculated and stored in the RAM 82 a based on the number of pulses applied to the step motor 91, the calculated number of bills stored in the RAM 82 may involve an error of i−1. As will be noted from FIG. 6, different bite amount regulation is effected for a given number of bills depending on whether the presser 10 is operative or inoperative. This is related to the fact that bills in circulation for a long time are usually wrinkled and therefore form a higher stack than the same number of new bills. It may therefore happen that a bill stack whose number of bills would ordinarily make it too low to be detected by the sensor 72 will in fact be detected by the sensor 72. Thus, in some cases, the presser 10 may not operate to allow the presser plate 63 to press down on a stack of bills that should normally be pressed down thereby. In such a case, therefore, the bite amount of the separation rollers 41, 41 into the feed-out roller 37 is controlled to a smaller value based on the number of stacked bills stored in the RAM 82. The likelihood of two or more bills being simultaneously kicked out and of the feed-out roller 37 and the separation rollers 41, 41 being incapable of separating them one by one is greater when the presser 10 is in operation than when it is not because the pressure exerted on the bills stacked on the elevator plate 7 by the presser plate 63 when the presser 10 is in operation increases the frictional force among the bills near the bottom of the stack. For the same number of bills stacked on the elevator plate 7, this embodiment therefore regulates the bite amount of the separation rollers 41, 41 into the feed-out roller 37 to a smaller value when the presser 10 is operative than when it is inoperative.

The CPU 80 uses the number of stacked bills stored in the RAM 82 as address data for retrieving a bite amount from the table of FIG. 6 stored in the ROM 81 and then regulates the bite amount of the separation rollers 41, 41 into the feed-out roller 37 to the retrieved value by driving the step motors 55, 55 to swing the arms 53, 53 via the gears 54, 54 and the sector gears 52, 52. The bite amount of the separation rollers 41, 41 into the feed-out roller 37 is detected by the rotary encoders 88, 88. The CPU 80 stores the detection signals from the rotary encoders 88, 88 in the RAM 82.

The CPU 80 then sends a drive signal to the motor 92 to rotate the kick rollers 34, 34 and the feed-out roller 37.

By this the bills stacked on the elevator plate 7 are successively dispensed from the bottommost bill, separated one by one by the feed-out roller 37 and the separation rollers 41, 41, and fed downstream of the bill stacker 1. The sensor 73 detects each dispensed bill and sends a detection signal to the CPU 80. Each time the CPU 80 receives a detection signal from the sensor 73, it decreases the number of stacked bills stored in the RAM 82 by one.

Thus, as the bills are being dispensed from the bill stacker 1, the CPU 80 regulates the bite amount of the separation rollers 41, 41 into the feed-out roller 37 by driving the step motors 55, 55 to establish the bite amount retrieved from the table stored in the ROM 81 using as address data the number of bills stacked on the elevator plate 7 stored in the RAM 82. Moreover, when the dispensation of bills off the elevator plate 7 has progressed to the point that the sensor 72 no longer detects bills stacked on the elevator plate 7, the CPU 80 outputs a drive signal to the step motor 93 so as to lower the elevator member 65 to the dispensation position and allow the weight of the presser plate 63 to press down on the bills stacked on the elevator plate 7, thereby ensuring reliable dispensation of the bills by the frictional force between the bills and the kick rollers 34, 34, and also operates the step motors 55, 55 to regulate the bite amount of the separation rollers 41, 41 into the feed-out roller 37 to that specified by the table stored in the ROM 81.

When the operation of dispensing bills from the bill stacker 1 has been completed, the CPU 80 outputs a drive signal to the step motor 93 to raise the elevator member 65 and thereby move the presser plate 63 to, and stop it at, the retracted position outside the bill stacking space 5.

The CPU 80 further operates the step motor 91 to lower the elevator plate 7 to its lowest position. Upon detection of the elevator plate 7 by the sensor 71, it again operates the step motor 91 to raise the elevator plate 7 until the bill guide plate 13 is detected by the sensor 70 and stores the number of pulses applied to the step motor 91 for this operation in the RAM 82. When the CPU 80 receives the detection signal indicating detection of the bill guide plate 13 from the sensor 70, it operates the step motor 91 to lower the elevator plate 7 until input of the bill guide plate 13 detection signal from the sensor 70 terminates and thereafter sends it a predetermined number of pulses to lower the elevator plate 7 a predetermined distance D equivalent to the thickness of i number of bills. The elevator plate 7 is held in this position.

According to this embodiment, bills can be reliably separated and dispensed one at a time by regulating the bite amount (meshing depth) of the separation rollers 41, 41 into the feed-out roller 37 in accordance with the number of bills stacked on the elevator plate 7 and whether or not the bills are pressed down by the presser 10, in other words, in accordance with the frictional force between the bottommost of the bills stacked on the elevator plate 7 and the kick rollers 34, 34.

The present invention has thus been shown and described with reference to specific embodiments. However, it should be noted that the present invention is in no way limited to the details of the described arrangements but changes and modifications may be made without departing from the scope of the appended claims.

For example, while the foregoing embodiment is equipped with two separation rollers 41, 41 supported on separate support shafts 40, 40 and therefore requires two bite amount regulators 50, 50, it is instead possible to support the separation rollers 41, 41 on a single support shaft 40 and provide only a single bite amount regulator 50.

Moreover, the invention is not limited to the arrangement of the foregoing embodiment whereby the lowest position of the elevator plate 7 is used as a reference position, the vertical position of the elevator plate 7 is calculated from the number of pulses applied to the step motor 91, the number of bills stacked on the elevator plate 7 is estimated from the distance between the elevator plate 7 and the bill guide plate 13, and the bite amount of the separation rollers 41, 41 into the feed-out roller 37 is regulated based on the estimated number of bills. Instead, the bite amount of the separation rollers 41, 41 into the feed-out roller 37 can be regulated based on an estimation of the number of bills stacked on the elevator plate 7 made from the bill count of the sensor 85 installed inside the bill discrimination passage to count the bills taken into the bill stacker 1 and the bill count of the sensor 73 that detects the bills dispensed from the bill stacker 1 or based on an estimation of the number of bills stacked on the elevator plate 7 made from the height of the bill stack on the elevator plate 7 ascertained from the outputs of multiple sensors provided in the bill stacker 1 in addition to the sensor 72 for detecting the height of the bill stack on the elevator plate 7. Moreover, when the bill feed-out device according to the present invention is provided in, for example, a deposited bill storage box for temporarily storing bills deposited in a bill handling machine, the bite amount of the separation rollers 41, 41 into the feed-out roller 37 can be regulated based on an estimation of the number of bills stacked on the elevator plate 7 made from the bill value or bill number entered through the deposit instruction unit 94.

Further, the foregoing embodiment checks whether or not the sensor 72 detects the bills stacked on the elevator plate 7, i.e., checks whether or not the height of the bill stack on the elevator plate 7 is equal to or higher than a prescribed value sufficient for the weight of the bills to produce enough friction between the bottommost bill and the kick rollers 34, 34 to ensure kick-out of the bottommost of the stacked bills by the kick rollers 34, 34 even if the bills stacked on the elevator plate 7 are not pressed down by the presser 10, and decides whether or not to operate the presser 10 accordingly. The invention is not limited to this, however, and it is instead possible to determine whether or not the presser 10 should be operated based on an estimation of the number of bills stacked on the elevator plate 7 made from the distance between the elevator plate 7 and the bill guide plate 13 ascertained by using the number of pulses applied to the step motor 91 to calculate the vertical position the elevator plate 7 relative to the lowest position of the elevator plate 7 as a reference position, based on an estimation of the number of bills stacked on the elevator plate 7 made from the height of the bill stack on the elevator plate 7 ascertained from the outputs of multiple sensors provided in the bill stacker 1 in addition to the sensor 72 for detecting the height of the bill stack on the elevator plate 7, based on an estimation of the number of bills stacked on the elevator plate 7 made from the bill value entered through the deposit instruction unit 94, or based on an estimation of the number of bills stacked on the elevator plate 7 made from the bill count of the sensor 85 and the bill count of the sensor 73.

Further, in the present invention, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a bill feed-out device that can reliably dispense bills one at a time even when the number of bills stacked therein becomes large.

What is claimed is:

1. A bill feed-out device adapted for dispensing bills from a bill storage box, said bill feed-out device comprising a bill stacking plate disposed in the bill storage box to support stacked bills on its upper surface, at least one kick roller means provided below the bill stacking plate to be contactable with a bottommost bill of the bills stacked on the bill stacking plate for kicking the bottommost bill laterally, a feed-out roller means, located downstream relative to a bill kick-out direction of the kick roller means and having multiple large-diameter portions and multiple small-diameter portions, for feeding further downstream bills kicked out by the kick roller means, at least one separation roller means which has multiple large-diameter portions and multiple small-diameter portions and whose multiple large-diameter portions can mesh into the multiple small-diameter portions of the feed-out roller means for separating one by one bills present between itself and the feed-out roller means, a stacked bill number detecting means for detecting the number of bills stacked on the bill stacking plate, a bite amount regulating means responsive to the number of stacked bills detected by the stacked bill number detecting means for regulating depth of meshing of the multiple large-diameter portions of the separation roller means into the multiple small-diameter portions of the feed-out roller means.

2. A bill feed-out device in accordance with claim 1 wherein the bite amount regulating means regulates the meshing depth of the at least one separation roller means into the feed-out roller means to increase the meshing depth of the multiple large-diameter portions of the separation roller means into the multiple small-diameter portions of the feed-out roller means in proportion as number of stacked bills detected by the stacked bill number detecting means increases.

3. A bill feed-out device in accordance with claim 2 wherein the bite amount regulating means includes step motor means and a rotation angle of a drive shaft of the step motor means can be detected by rotary encoder means.

4. A bill feed-out device in accordance with claim 3 which further comprises a presser means for pressing down on the bills stacked on the bill stacking plate from above when less than a prescribed number of bills are stacked on the bill stacking plate and the bite amount regulating means is adapted to increase the meshing depth of the multiple large-diameter portions of the separation roller means into the multiple small-diameter portions of the feed-out roller means when the presser means presses down on the bills stacked on the bill stacking plate from above.

5. A bill feed-out device in accordance with claim 4 which further comprises a stack height sensor for detecting based on the stack height of the bills stacked on the bill stacking plate whether or not the number of bills stacked on the bill stacking plate has reached the prescribed number.

6. A bill feed-out device in accordance with claim 3 which further comprises at least one arm means whose one end portion is swingably attached to a support shaft and whose other end supports at least one separation roller means, and at least one swinging means for swinging the arm means, the bite amount regulating means being adapted to regulate the meshing depth of the multiple large-diameter portions of the separation roller means into the multiple small-diameter portions of the feed-out roller means by swinging the swinging means about the support shaft.

7. A bill feed-out device in accordance with claim 3 which further comprises a dispensed bill sensor installed downstream of the feed-out roller means for counting the number of bills fed out by the feed-out roller means.

8. A bill feed-out device in accordance with claim 7 which further comprises, in addition to the dispensed bill sensor, an incoming bill sensor for counting the number of bills taken into the bill storage box.

9. A bill feed-out device in accordance with claim 7 which further comprises multiple sensors spaced vertically in the bill storage box.

10. A bill feed-out device in accordance with claim 7 which further comprises a presser means for pressing down on the bills stacked on the bill stacking plate from above when less than a prescribed number of bills are stacked on the bill stacking plate and the bite amount regulating means is adapted to increase the meshing depth of the multiple large-diameter portions of the separation roller means into the multiple small-diameter portions of the feed-out roller means when the presser means presses down on the bills stacked on the bill stacking plate from above.

11. A bill feed-out device in accordance with claim 10 which further comprises a stack height sensor for detecting based on the stack height of the bills stacked on the bill stacking plate whether or not the number of bills stacked on the bill stacking plate has reached the prescribed number.

12. A bill feed-out device in accordance with claim 7 which further comprises a bill number input means for inputting the number of bills from outside.

13. A bill feed-out device in accordance with claim 7 which further comprises at least one arm means whose one end portion is swingably attached to a support shaft and whose other end supports at least one separation roller means, and at least one swinging means for swinging the arm means, the bite amount regulating means being adapted to regulate the meshing depth of the multiple large-diameter portions of the separation roller means into the multiple small-diameter portions of the feed-out roller means by swinging the swinging means about the support shaft.

14. A bill feed-out device in accordance with claim 2 which further comprises step motor means for raising and lowering the bill stacking plate and wherein the stacked bill number detecting means detects the number of bill stacked on the bill stacking plate based on a number of pulses applied to the step motor.

15. A bill feed-out device in accordance with claim 2 which further comprises a dispensed bill sensor installed downstream of the feed-out roller means for counting the number of bills fed out by the feed-out roller means.

16. A bill feed-out device in accordance with claim 15 which further comprises, in addition to the dispensed bill sensor, an incoming bill sensor for counting the number of bills taken into the bill storage box.

17. A bill feed-out device in accordance with claim 15 which further comprises multiple sensors spaced vertically in the bill storage box.

18. A bill feed-out device in accordance with claim 15 which further comprises a bill number input means for inputting the number of bills from outside.

19. A bill feed-out device in accordance with claim 15 which further comprises a presser means for pressing down on the bills stacked on the bill stacking plate from above when less than a prescribed number of bills are stacked on the bill stacking plate and the bite amount regulating means is adapted to increase the meshing depth of the multiple large-diameter portions of the separation roller means into the multiple small-diameter portions of the feed-out roller means when the presser means presses down on the bills stacked on the bill stacking plate from above.

20. A bill feed-out device in accordance with claim 19 which further comprises a stack height sensor for detecting based on the stack height of the bills stacked on the bill stacking plate whether or not the number of bills stacked on the bill stacking plate has reached the prescribed number.

21. A bill feed-out device in accordance with claim 15 which further comprises at least one arm means whose one end portion is swingably attached to a support shaft and whose other end supports at least one separation roller means, and at least one swinging means for swinging the arm means, the bite amount regulating means being adapted to regulate the meshing depth of the multiple large-diameter portions of the separation roller means into the multiple small-diameter portions of the feed-out roller means by swinging the swinging means about the support shaft.

22. A bill feed-out device in accordance with claim 2 which further comprises a presser means for pressing down on the bills stacked on the bill stacking plate from above when less than a prescribed number of bills are stacked on the bill stacking plate and the bite amount regulating means is adapted to increase the meshing depth of the multiple large-diameter portions of the separation roller means into the multiple small-diameter portions of the feed-out roller means when the presser means presses down on the bills stacked on the bill stacking plate from above.

23. A bill feed-out device in accordance with claim 22 which further comprises a stack height sensor for detecting based on the stack height of the bills stacked on the bill stacking plate whether or not the number of bills stacked on the bill stacking plate has reached the prescribed number.

24. A bill feed-out device in accordance with claim 2 which further comprises at least one arm means whose one end portion is swingably attached to a support shaft and whose other end supports at least one separation roller means, and at least one swinging means for swinging the arm means, the bite amount regulating means being adapted to regulate the meshing depth of the multiple large-diameter portions of th e separation roller means into the multiple small-diameter portions of the feed-out roller means by swinging the swinging means about the support shaft.

* * * * *